US006460775B1

(12) United States Patent
Duan et al.

(10) Patent No.: US 6,460,775 B1
(45) Date of Patent: Oct. 8, 2002

(54) FLOW MONITOR FOR REWET SHOWERS

(75) Inventors: Shizhong Duan, Coquitlam (CA); Geoffrey Arthur Jones, North Vancouver (CA)

(73) Assignee: ABB, Inc., North Vancouver (CA)

( * ) Notice: Subject to any disclaimer, the term of this patent is extended or adjusted under 35 U.S.C. 154(b) by 71 days.

(21) Appl. No.: 09/824,113

(22) Filed: Apr. 2, 2001

(51) Int. Cl.[7] ..... B05B 17/04

(52) U.S. Cl. ..... 239/11; 239/8; 239/239; 239/71; 239/533.1; 239/589; 73/37; 162/263

(58) Field of Search ..... 239/8, 11, 67, 239/71, 423, 424, 533.1, 589, 752; 73/37; 162/199, 263

(56) References Cited

U.S. PATENT DOCUMENTS 4,430,886 A * 2/1984 Rood ..... 73/37
5,316,217 A * 5/1994 Guzowski et al. ..... 239/71
5,494,227 A * 2/1996 Costantini ..... 239/752
5,680,987 A * 10/1997 Taylor ..... 162/199
5,725,737 A * 3/1998 Pikulik et al. ..... 162/263

* cited by examiner

*Primary Examiner*—Steven J. Ganey
(74) *Attorney, Agent, or Firm*—Michael M. Rickin, Esq.

(57) ABSTRACT

An atomizing nozzle for use with a rewet shower or a steam box. The nozzle has first and second orifices and a pressure port which allows the pressure between the orifices to be measured. The nozzle also has a pressure port upstream of the two orifices that allows for the measuring of the regulated water pressure from an actuator attached to the atomizing unit. The measured pressures can be used to determine if either orifice is completely blocked or if one orifice is partially blocked or the other orifice is worn.

29 Claims, 2 Drawing Sheets

*Figure 1: An integrated actuator nozzle unit using double orifices.*

FLOW MONITOR FOR REWET SHOWERS

FIELD OF THE INVENTION

This invention relates to an apparatus and method to monitor flow passing through orifices or nozzle, and, more specifically, to an apparatus and method intended for use with a rewet shower or a steam-box for the paper making industry.

DESCRIPTION OF THE PRIOR ART

A modern paper machine turns pulp which is a mixture of water and fiber into paper through consecutive processes. Three sections of the machine which are named forming, pressing and drying play the most important roles in paper making. Normal pulp at the headbox contains about 1% fiber and 99% water.

The former section of the paper machine takes advantage of gravity and vacuum suction to remove water from the pulp and form a sheet thereafter. In the press section, the sheet is conveyed through a series of presses where additional water is removed and the fiber web is consolidated. The water concentration is reduced to about 40% after pressing. The remaining water is further evaporated and fiber bonding develops as the paper contacts a series of steam-heated cylinders in the drying section. The moisture level drops down to about 5% to 10% after the drying section.

One of the important properties of a paper product is the moisture level. Even more important than the absolute moisture level is the uniformity of moisture in the paper product in both the machine direction and the cross machine direction. A variation in moisture content of the sheet will often affect paper quality as much or more than the absolute moisture level. There are numerous influences on the paper machine that can cause variation of the moisture content, particularly in the cross machine direction. Wet edges and characteristic moisture profiles are common occurrences on paper sheets produced by a paper machine. Thus a number of commercially available actuator systems have been developed to offer control of the moisture profile during paper production.

One such actuator system is a water rewet shower that selectively adds water droplets onto the paper surface. The rewet showers employ actuator nozzle units that are mounted in sequential segments (or zones) across the paper machine direction. Water flow rate is controlled independently through each actuator nozzle unit. Hence the moisture profile on the paper sheet can be adjusted by the rewet system. Air-atomizing nozzles are normally used in those rewet showers to generate droplets small enough to produce rewet effectively.

The nozzles of the water rewet showers are normally positioned a few inches away from the paper sheet. There is a possibility that a nozzle orifice could be partially or fully blocked by fibers around the paper machine. Another potential problem is the wearing out of the nozzle orifice over time because the paper machine, and thus the spraying system, is operating around the clock. Variation of the nozzle orifice affects the flow characteristics of the nozzle, and consequently the performance of the spraying system.

Another such actuator system to control the moisture profile is a steam-box that is used on a paper machine to control paper moisture and to dewater. The steam box adds both moisture and heat to the paper surface. Adding water to the paper appears to be counterproductive, as the final purpose of the paper machine is to control the moisture to a relatively low level typically 5% to 10%. It is the heat that is added by the steam-box that accomplishes that result. Experiments show that heating the paper with steam allows the pressing process to remove much more water than that added by condensation of the steam.

Due to the ready availability and affordability of steam in most plants, devices using steam surpass those using other heat sources. Steam-boxes experience the same problem as a water spraying system. Fibers from outside of a steam-box can block the steam flow orifices and degrade the performance of the steam-box. There are many steam-box manufacturers around the world, but none has a device or methodology that can monitor the orifice status in the steam boxes.

The amount of flow passing through each segment (or zone) of a rewet shower or a steam-box is adjusted through an actuator located in that segment. An actuator is a device that converts an input signal into an output movement. The output movement then can be employed in a control mechanism. In the rewet shower and the steambox, water or steam is the medium to be controlled.

There are two types of actuators that can be used in a water rewet shower or a steam-box. One type converts a control signal to a linear movement. The linear movement is then employed to adjust proportionally an opening area in a valve mechanism. The flow amount passing through this valve is therefore controllable in a linear fashion by keeping the upstream flow pressure constant, and the varying opening area at the valve determines the flow rate.

The other actuator type is referred to as the regulator type. The regulator-type actuator regulates flow pressure feeding a constant opening based on a controlling reference pneumatic pressure. The varying pressure feeding the constant orifice determines the flow rate.

The regulator-type actuator is especially effective for applications requiring small flow control. It can be appreciated that precisely adjusting the opening of the small orifice is very difficult. Thus it is much easier to keep the small orifice untouched while regulating the flow pressure feeding that orifice.

Another important component in a rewet shower is the nozzle. Two kinds of nozzles, hydraulic and air atomizing, are widely used for water sprays. A hydraulic nozzle uses energy from a highly pressurized source to break water into droplets at the nozzle. The flow rate passing through a hydraulic nozzle is a function of the source pressure. The spraying pattern, such as spraying angle and velocity profile, is affected by the pressure as well. The fact that the droplet size is related to the flow rate makes the hydraulic nozzle ideal for operation at a fixed design point.

An air-atomizing nozzle uses energy from pressurized air to break water into small droplets. The spraying pattern is affected by air pressure only, and is independent of the water flow rate passing through the nozzle up to a certain point. The droplet size from an air-atomizing nozzle depends more on the air pressure than the water flow rate. Separating droplet size control from water flow control substantially simplifies the controlling strategy of a spraying system.

Water spraying rewet showers and steam-boxes both work under a dusty environment around paper machines. As was described above, the flow orifices in both systems are subject to fibers that could partially or completely block the flow passages. In addition the flow orifices will wear because the systems are normally operating around the clock for a long period of time. All of the existing rewet showers or steam-boxes do not Shave feedback mechanisms that can effectively monitor the status of the flow orifices.

Traditionally, pressure drop through a single orifice opening is measured for the calculation of the flow rate. This technique fails to work when the orifice opening area changes due to blockage or wear. Therefore a new technique had to be developed.

SUMMARY OF THE INVENTION

An actuator unit for controlling the flow of fluid from a source. The actuator unit has an atomizing nozzle and an actuator having a port for connection to a source of pneumatic control pressure. The atomizing nozzle has:

(i) a port for connection to a source of water, the actuator using the pneumatic control pressure to provide from the water source regulated water pressure to the atomizing nozzle;

(ii) a first orifice connected to the water port;

(iii) a second orifice downstream of the first orifice;

(iv) a first pressure port upstream of the first orifice for monitoring the regulated water pressure from the actuator; and (v) a second pressure port located between the first orifice and the second orifice for monitoring the pressure between the first and the second orifices.

An atomizing nozzle having:

(a) a water inlet for providing regulated water pressure from a source of water to the atomizing nozzle;

(b) a first orifice connected to the water inlet;

(c) a second orifice downstream of the first orifice;

(d) a first pressure port upstream of the first orifice for monitoring the regulated water pressure from the actuator; and (e) a second pressure port located between the first orifice and the second orifice for monitoring the pressure between the first and the second orifices.

An atomizing nozzle having:

(a) a nozzle body having a water inlet for providing regulated water pressure from a source of water to the atomizing nozzle;

(b) a first orifice connected to the water inlet;

(c) a second orifice downstream of the first orifice;

(d) a water nozzle tube in the nozzle body;

(e) a first chamber formed by the nozzle body and the first orifice and the second orifice for receiving the regulated water pressure from the water source;

(f) a second chamber downstream of the first chamber, the second chamber formed between the first orifice and the second orifice;

(g) a first pressure port connected to the first chamber for monitoring the regulated water pressure from the water source; and (h) a second pressure port connected to the second chamber for monitoring the pressure between the first and the second orifices.

In an atomizing nozzle having:

(a) a nozzle body having a water inlet for providing regulated water pressure from a source of water to the atomizing nozzle;

(b) a first orifice connected to the water inlet;

(c) a second orifice downstream of the first orifice;

(d) a first pressure port located upstream of the first orifice; and (e) a second pressure port located between the first orifice and the second orifice;

a method for determining the status of the first and the second orifices. The method has the steps of:

(i) measuring at the first pressure port the pressure upstream of the first and second orifices, the measured upstream pressure predetermining the pressure between the first orifice and the second orifice.

(ii) measuring at the second pressure port the pressure between the first and second orifices; and (iii) determining a partial or whole blockage of the first orifice or the second orifice from the pressure measured at the first pressure port and the pressure measured at the second pressure port.

DESCRIPTION OF THE PREFERRED EMBODIMENT(S)

The present invention uses a double orifice technique to measure pressure. The double orifice configuration is shown in the actuator nozzle unit 10 of FIG. 1. In the atomizing nozzle 22 included in the unit 10 the pressure is measured between the two orifices 12 and 14, and the pressure change is monitored over time under a constant upstream pressure.

Figure 1:
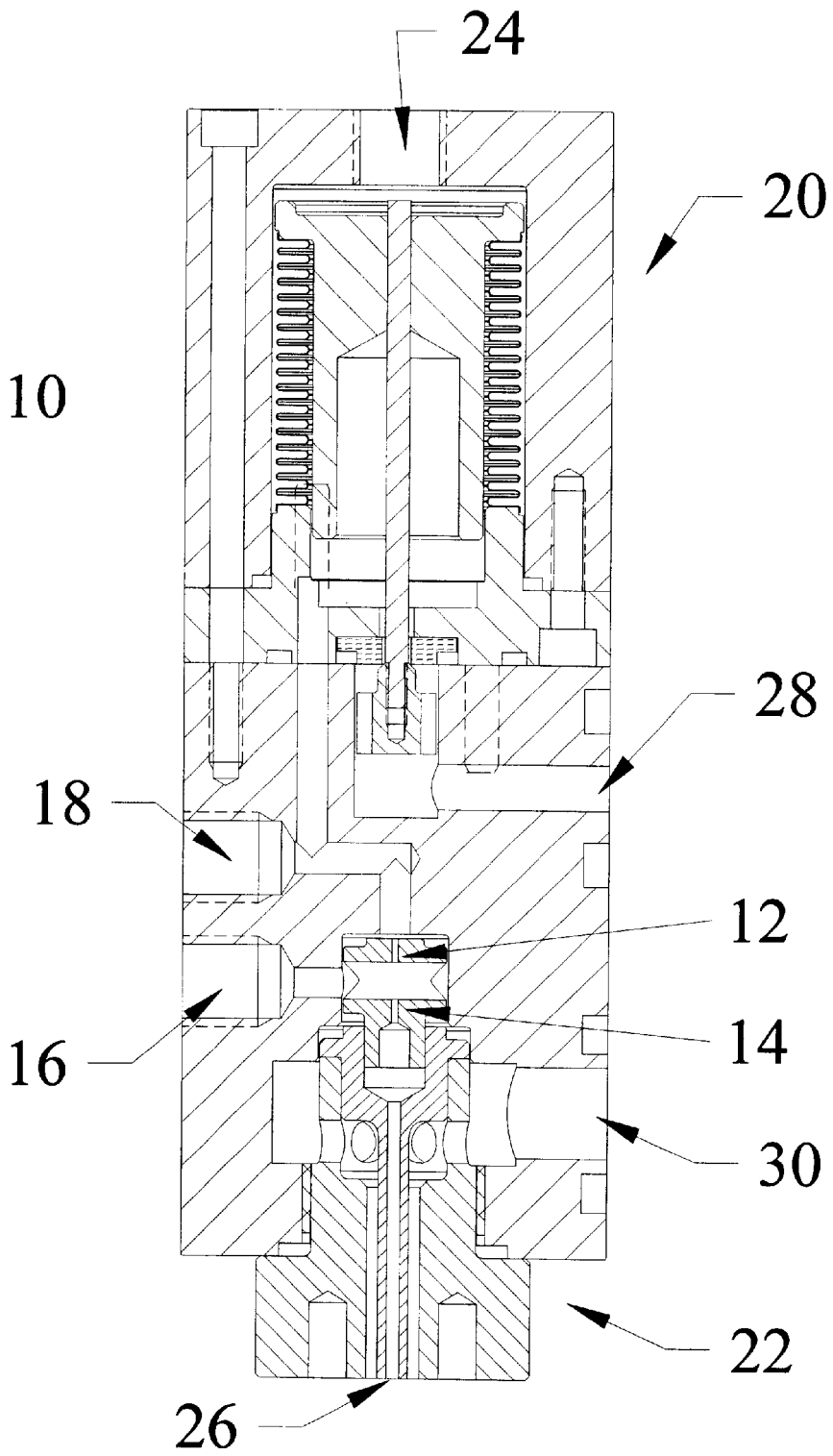
FIG. 1 shows an actuator nozzle unit that includes the double orifice configuration of the present invention.

As is shown in FIG. 1 there is a pressure port 16 located right between the two orifices 12 and 14. There is also another pressure port 18 upstream of the two orifices 12 and 14 that monitors the regulated water pressure from the actuator 20 included in the unit 10. The upstream pressure measured is compared with the pneumatic control pressure sent to the actuator 20 through port 24. This comparison results in the performance diagnosis of the actuator 20. The pressure measured between the two orifices 12 and 14 in combination with the pressure measured upstream can be used to monitor the status of the orifices 12 and 14.

The technique of the present invention is based on the fact that there is always a pressure drop when a moving fluid passes an orifice. The pressure between the double orifices 12, 14 is a portion of the upstream pressure, and the ratio between the two pressures is a constant if there is no geometrical variation in the flow passage. If the upstream orifice 12 of the double orifices is partially blocked, the measured pressure between the double orifices 12 and 14 will be lower than normal. A zero pressure measurement between the orifices 12 and 14 indicates full blockage at the upstream orifice during normal operation. When wearing occurs to the upstream orifice, increasing pressure should be expected between the double orifices 12 and 14. Similarly, a blockage at the downstream orifice 14 of the double orifices 12 and 14 resists the flow more and consequently a higher pressure should occur between the orifices 12 and 14. When the downstream orifice 14 is fully blocked, the pressure between the two orifices 12 and 14 equals the upstream pressure. Wearing of the downstream orifice 14 results in a pressure drop.

In short, a pressure drop between the orifices 12 and 14 indicates either blockage at the upstream orifice 12 or wearing of the downstream orifice 14. Pressure increasing between the orifices 12 and 14 implies that there is either wearing at the upstream orifice 12 or blockage of the downstream orifice 14. Although there is no way to tell which orifice 12 or 14 has caused the variation in the measured pressure a user of the flow monitor of the present invention should be able to conclude that it is time to change the orifices. The double orifices 12 and 14 can be designed as one component for easy replacement.

The double orifice 12 and 14 is used in an integrated actuator nozzle unit 10 as is shown in FIG. 1. The unit 10 consists of a regulator-type actuator 20 at the top portion and an air-atomizing nozzle 22 at the bottom portion. There is a port 24 at the top of the actuator 20 that is connected to an input pneumatic control signal. The pneumatic pressure sent to the regulator-type actuator controls the water pressure feeding the double orifices 12 and 14 downstream. The diameters of the double orifices 12 and 14 determine the maximum flow capacity from this unit. Based on flow specification for each application, double orifices 12 and 14 with different orifice diameters can be used.

As was previously described there are two pressure ports 16, 18 on the left side of the unit 10 that each serve for monitoring the pressure. The pressure port 18 is used for actuator performance monitoring. The measurement at pressure port 16 combined with the measurement at port 18 is utilized to monitor the status of those two flow orifices 12 and 14, and the nozzle orifice 26 further downstream.

The nozzle 22 has one port 28 connecting to a source of water not shown in FIG. 1 and another port 30 connecting to a source of pressurized atomizing air not shown in FIG. 1. Atomizing air pressure controls the water drop size through a traditional coaxial air/water nozzle as shown in FIG. 1. Water passing through the two orifices 12 and 14 in series flows into the center orifice 26 of the nozzle to form a jet. The pressurized atomizing air flows through the annulus around the water jet. The atomizing air jet moves much faster than the inside water jet does. The shearing force generated by the sharp velocity gradient at the boundary between the two jets breaks water into small droplets. Water particles with size less than 50 microns in diameter can be expected from the nozzle. The actuator nozzle unit 10 can be used alone or mounted on a common manifold in an array for applications such as a rewet shower.

In a practical rewet shower with an array of the actuator nozzle units 10 discussed above, data for each actuator nozzle unit 10 should be recorded during the initial setup of the rewet system. The data includes pressure readings at port 16 and 18 against each possible pneumatic control signal at port 24. This data can be used as a reference later on during normal operation to check the status of the double orifices 12 and 14 or nozzle orifice 26, and the performance of the regulator-type actuator 20 as well.

At any time during normal operation, the control signal at port 24 and corresponding pressure readings from port 16 and port 18 can be acquired and then compared to the recorded data. If the pressure reading from port 18 does not match with the normal value, the regulator-type actuator is malfunctioning. A discrepancy between the pressure reading at port 16 and the recorded normal value indicates problems at the double orifices 12 and 14 or nozzle orifice 26.

Figure 2:
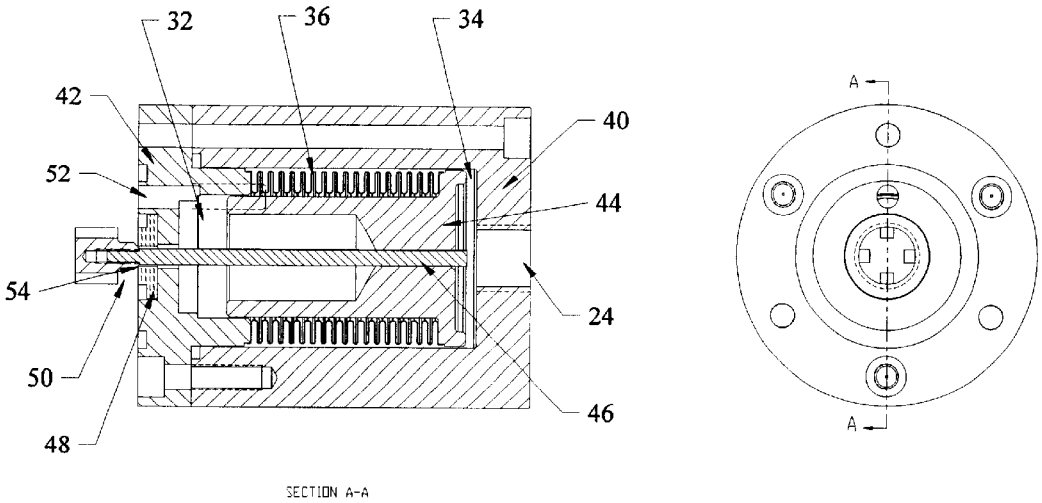
FIG. 2 shows an embodiment for the regulator type actuator which is part of the actuator nozzle unit of FIG. 1.

Referring now to FIG. 2 there is shown an embodiment for the regulator-type actuator 20. The embodiment shown in FIG. 2 is the subject matter of U.S. patent application Ser. No. 09/712,417 filed on Nov. 14, 2000 and entitled "Bellows Actuator For Pressure And Flow Control." It should be appreciated that while a specific embodiment for actuator 20 is shown in FIG. 2, actuator 20 may be embodied in any manner well known to those of ordinary skill in the art to control the pressure of the water fed to double orifices 12 and 14.

Actuator 20 consists of an internal chamber 32 and an external chamber 34 separated by a flexible metal bellows 36. The external chamber 34 is formed by the air inlet containment cup 40, the bellows 36, the water inlet end piece 42 and the piston 44. The control air inlet 24 feeds into the external chamber 34. The internal chamber 32 is formed by the water inlet end piece 42, the bellows 36 and the piston 44. The source water inlet 50 feeds into the internal chamber 32. A valve stem 46 attached to the piston 44 with a valve seat 48 forms a valve at the source water inlet 50. A spray water outlet 52 directs the water to the double orifices 12 and 14 and the nozzle orifice 26.

Initial setup of the actuator 20 involves compressing the metal bellows 36 a predetermined amount and attaching the valve stem 46 such that the valve orifice 54 is closed at this pre-compressed setting. In addition, the water inlet end piece 42 and the piston 44 are designed to diametrically guide each other in their relative movement as well as act as an anti-squirm guide for the bellows 36.

The actuator 20 works to control the pressure fed to the double orifices 12 and 14 and the nozzle orifice 26 using the pneumatic control air pressure as a reference. Source water is fed to the source water inlet 50 at a pressure in excess of the maximum desired pressure for the spray nozzle 22. Control air is fed to the metal bellows 36 through the air inlet containment cup 40.

The air pressure in the external chamber 34 acts against the effective area of the bellows 36 and creates an operating force, which is resisted by three opposing forces. The first opposing force is formed by the spring action of the pre-compressed metal bellows 36. The second opposing force is formed by the pressure of the source water acting against the relatively small area of the valve orifice 54 opening. The third opposing force is formed by the spray water pressure in the internal chamber 32 acting against the effective area of the bellows 36. The first two reactive forces are substantially small or constant which allows changes to the control air pressure to predictably affect the pressure of the water feeding the double orifices 12 and 14 and the nozzle orifice 26. The actuator 20 operates on a balance of these forces.

If the control air pressure is less than the kickoff pressure, determined by the amount of pre-compression of the bellows 36, the valve stem 46 remains against the valve seat 48 and no water passes through the valve. The double orifices 12 and 14 and nozzle orifice 26 downstream receive no water pressure to feed them.

When the control air pressure exceeds the kickoff pressure of the actuator 20, the valve stem 46 is pushed down by the piston and water flows through the valve orifice 54 into the internal chamber 32 and out to the double orifices 12 and 14 and nozzle orifice 26. The double orifices 12 and 14 and the nozzle orifice 26 downstream allow water flow through it but also offer resistance to such flow. Thus the pressure in the internal chamber 32 builds. As the pressure in the internal chamber 32 increases, the sum of the opposing forces increase until it matches the force of the control air pressure in the external chamber 34. A balance point between control force and reactive opposite forces results in a determined flow rate passing through the double orifices 12 and 14 and the nozzle orifice 26.

Figure 3:
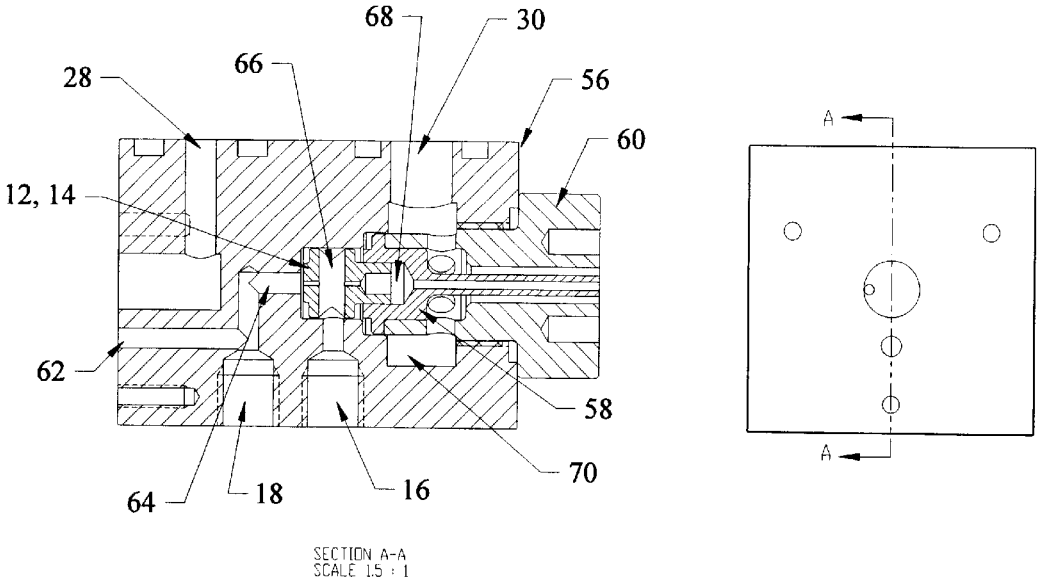
FIG. 3 shows an embodiment for the nozzle portion of the actuator nozzle unit of FIG. 1.

Referring now to FIG. 3 there is shown an embodiment for the nozzle portion of the actuator nozzle unit. The nozzle portion consists of a nozzle body 56, the double orifices 12 and 14, a water nozzle tube 58 and an air cap 60. The nozzle body 56 also serves as a mounting base for the actuator 20. The source water inlet 28 on the nozzle body 56 is connected to the source water inlet 50 to the actuator 20. The spray water outlet 52 from the actuator 20 is aligned with the regulated water inlet 62 on the nozzle body 56.

There are three chambers along the water flow passage in the nozzle body 56. The pressure port 18 is connected to the upstream chamber 64 formed by the nozzle body 56 and the double orifices 12 and 14. The pressure port 16 is connected to the middle chamber 66 between the double orifices 12 and 14 and is surrounded by the nozzle body 56. The double orifices 12 and 14 and the water nozzle tube 58 form the third or downstream chamber 68. Atomizing air feeds into the air chamber 70 formed by the nozzle body 56 and the air cap 60 through the atomizing air inlet 30. The pressurized air in the air chamber 70 blows out through the annulus formed between the water nozzle tube 58 and the air cap 60.

Water from the actuator 20 feeds into the upstream chamber 64, gushes into the middle chamber 66 by passing through the upstream orifice 12, enters the downstream chamber 68 by passing through the downstream orifice 14 and finally flows out of the nozzle 22 through the nozzle orifice 26 of the water nozzle tube 58. The pressure head of the pressurized water feeding the orifices 12, 14 and nozzle orifice 26 is reduced due to the head losses at the two orifices 12, 14 and at the nozzle orifice 26. The rest of the pressure head is then converted to kinetic energy (velocity) exiting from the water nozzle tube 58. From the pressure point of view, the pressure at the upstream chamber 64 is dropped three times when the water passes the two orifices 12, 14 and the nozzle orifice 26 respectively. The water pressure eventually hits the atmospheric pressure outside the nozzle 22.

The nozzle orifice 26 of the water nozzle tube 58, which affects the droplet size from the nozzle 22, is the same for all applications. Orifice diameters of the double orifices 12, 14 determine the maximum water flow capacity for each individual application. For most of the applications, the nozzle orifice 26 is much larger than the flow orifice diameter. Therefore the pressure drop through the water nozzle tube 58 is substantially less than the pressure drop through any one of the two orifices 12, 14. A relatively large pressure value in the middle chamber 66 makes precise pressure measurement there easier. That is why the present invention uses two orifices 12, 14 instead of one in the design. In practice, the diameters of the two orifices 12, 14 can be either identical or different.

The pressure reading at the pressure port 18 compared to the actuator control input at port 24 can be used as diagnostic information for the actuator performance. The pressure at the middle chamber 66 is picked up at pressure port 16. This middle chamber pressure, combining with the pressure reading at pressure port 18 is the key information for monitoring the status of both the orifices 12, 14 and the water nozzle tube 58.

Material wearing or contaminant clog at the orifices 12, 14 or nozzle orifice 26 is reflected by the pressure variation at the middle chamber 66. At a constant feeding pressure upstream, the pressure in the middle chamber 66 is a constant if there are no changes in geometry along the flow passage, especially at the two orifices 12, 14 and the water nozzle tube 58. As described above, pressure increasing in the middle chamber 66 implies wear at the upstream orifice 12, or blockage at the downstream orifice 14 or nozzle orifice 26. Pressure reducing in the middle chamber 66 suggests wear at the downstream orifice 14 or nozzle orifice 26, or blockage at the upstream orifice 12.

The actuator nozzle design of the present invention gives a continuous water flow response to input control but without hysteresis. Moreover the actuator nozzle design allows a remote generation of pneumatic control signal, the reference pressure, for control of the actuator nozzle unit. Using a pneumatic signal offers reliability when placing the actuator nozzle unit in a harsh environment such as a paper mill. The very short stroke required allows the actuator design to be small in size and last very long in service.

As those of ordinary skill in the art can appreciate, the double orifice of the present invention can have other applications where the need exists for a reliable method to monitor the status of flow orifices when orifice blocking or wearing is an issue. While the double orifices as described above are designed as one component it should be appreciated that the orifices can be designed in two separated parts that operate the same way as described above for the two orifices designed as one component.

It is to be understood that the description of the preferred embodiment(s) is (are) intended to be only illustrative, rather than exhaustive, of the present invention. Those of ordinary skill will be able to make certain additions, deletions, and/or modifications to the embodiment(s) of the disclosed subject matter without departing from the spirit of the invention or its scope, as defined by the appended claims.

What is claimed is:

1. An actuator unit for controlling the flow of fluid from a source comprising:

(a) an atomizing nozzle;

(b) an actuator having a port for connection to a source of pneumatic control pressure;

said atomizing nozzle comprising:

(i) a port for connection to a source of water, said actuator using said pneumatic control pressure to provide from said water source regulated water pressure to said atomizing nozzle;

(ii) a first orifice connected to said water port;

(iii) a second orifice downstream of said first orifice;

(iv) a first pressure port upstream of said first orifice for monitoring the regulated water pressure from said actuator; and (v) a second pressure port located between said first orifice and said second orifice for monitoring the pressure between said first and said second orifices.

2. The actuator unit of claim 1 wherein said first orifice and said second orifice have the same diameter.

3. The actuator unit of claim 1 wherein said atomizing nozzle further comprises an atomizing air inlet for providing pressurized atomizing air from a source of said air to said atomizing nozzle.

4. The actuator unit of claim 3 wherein said atomizing nozzle further comprises a nozzle body which includes said port for connection to a source of water; an air cap connected to said nozzle body; and an air chamber for receiving pressurized atomizing air from said pressurized atomizing air source formed by said nozzle body and said air cap.

5. The actuator unit of claim 4 wherein said atomizing nozzle further comprises a water nozzle tube in said nozzle body and an annulus formed by said water nozzle tube and said air cap, said annulus allowing said pressurized atomizing air to blow out of said air chamber.

6. The actuator unit of claim 1 wherein said atomizing nozzle further comprises a nozzle body which includes said port for connection to a source of water, and a water tube in said nozzle body.

7. The actuator unit of claim 6 wherein said atomizing nozzle water nozzle tube includes a nozzle orifice.

8. The actuator unit of claim 7 wherein said nozzle orifice has a diameter which is larger than the diameter of said first orifice and the diameter of said second orifice.

9. An atomizing nozzle comprising:

(a) a water inlet for providing regulated water pressure from a source of water to said atomizing nozzle;

(b) a first orifice connected to said water inlet;

(c) a second orifice downstream of said first orifice;

(d) a first pressure port upstream of said first orifice for monitoring the regulated water pressure from said actuator; and (e) a second pressure port located between said first orifice and said second orifice for monitoring the pressure between said first and said second orifices.

10. The atomizing nozzle of claim 9 further comprising an atomizing air inlet for providing pressurized atomizing air from a source of said air to said atomizing nozzle.

11. The atomizing nozzle of claim 10 further comprising a nozzle body which includes said water inlet; an air cap connected to said nozzle body; and an air chamber for receiving pressurized atomizing air from said pressurized atomizing air source formed by said nozzle body and said air cap.

12. The atomizing nozzle of claim 11 further comprising a water nozzle tube in said nozzle body and an annulus formed by said water nozzle tube and said air cap, said annulus allowing said pressurized atomizing air to blow out of said air chamber.

13. The atomizing nozzle of claim 9 further comprising a nozzle body which includes said water inlet, and a water tube in said nozzle body.

14. The atomizing nozzle of claim 13 wherein said water nozzle tube includes a nozzle orifice.

15. The atomizing nozzle of claim 14 wherein said nozzle orifice has a diameter which is larger than the diameter of said first orifice and the diameter of said second orifice.

16. The atomizing nozzle of claim 9 wherein said first orifice and said second orifice have the same diameter.

17. An atomizing nozzle comprising:

(a) a nozzle body having a water inlet for providing regulated water pressure from a source of water to said atomizing nozzle;

(e) a first orifice connected to said water inlet;

(f) a second orifice downstream of said first orifice;

(g) a water nozzle tube in said nozzle body;

(e) a first chamber formed by said nozzle body and said first orifice and said second orifice for receiving said regulated water pressure from said water source;

(f) a second chamber downstream of said first chamber, said second chamber formed between said first orifice and said second orifice;

(g) a first pressure port connected to said first chamber for monitoring said regulated water pressure from said water source; and (h) a second pressure port connected to said second chamber for monitoring the pressure between said first and said second orifices.

18. The atomizing nozzle of claim 17 further comprising a third chamber downstream of said second chamber, said third chamber formed by said water nozzle tube and said first orifice and said second orifice.

19. The atomizing nozzle of claim 17 further comprising an atomizing air inlet for providing pressurized atomizing air from a source of said air to said atomizing nozzle.

20. The atomizing nozzle of claim 19 further comprising an air cap connected to said nozzle body; and an air chamber for receiving pressurized atomizing air from said pressurized atomizing air source formed by said nozzle body and said air cap.

21. The atomizing nozzle of claim 20 further comprising an annulus formed by said water nozzle tube and said air cap said annulus allowing said pressurized atomizing air to blow out of said air chamber.

22. The atomizing nozzle of claim 17 wherein said water nozzle tube includes a nozzle orifice.

23. The atomizing nozzle of claim 22 wherein said nozzle orifice has a diameter which is larger than the diameter of said first orifice and the diameter of said second orifice.

24. The atomizing nozzle of claim 17 wherein said first orifice and said second orifice have the same diameter.

25. In an atomizing nozzle comprising:

(a) a nozzle body having a water inlet for providing regulated water pressure from a source of water to said atomizing nozzle;

(b) a first orifice connected to said water inlet;

(c) a second orifice downstream of said first orifice;

(d) a first pressure port located upstream of said first orifice; and (e) a second pressure port located between said first orifice and said second orifice;

a method for determining the status of said first and said second orifices comprising the steps of:

(i) measuring at said first pressure port the pressure upstream of said first and second orifices, said measured upstream pressure predetermining the pressure between said first orifice and said second orifice;

(ii) measuring at said second pressure port the pressure between said first and second orifices; and (iii) determining a partial or whole blockage of said first orifice or said second orifice from said pressure measured at said first pressure port and said pressure measured at said second pressure port.

26. The method of claim 25 wherein said determining step determines that either said first orifice is partially blocked or said second orifice is worn when said measured pressure at said second pressure port is below said predetermined pressure.

27. The method of claim 25 wherein said determining step determines that said first orifice is completely blocked when said measured pressure at said second pressure port is zero.

28. The method of claim 25 wherein said determining step determines that either said first orifice is worn or said second orifice is partially blocked when said measured pressure at said second pressure port is greater than said predetermined pressure.

29. The method of claim 25 wherein said determining step determines that said second orifice is completely blocked when said measured pressure at said second pressure port equals said upstream pressure.

* * * * *